United States Patent [19]

Handa

[11] Patent Number: 4,572,144

[45] Date of Patent: Feb. 25, 1986

[54] FUEL INJECTION TIMING CONTROL DEVICE

[75] Inventor: Shizuo Handa, Kariya, Japan

[73] Assignee: Nippondenso Co., Ltd., Kariya, Japan

[21] Appl. No.: 593,310

[22] Filed: Mar. 26, 1984

[30] Foreign Application Priority Data

Mar. 26, 1983 [JP] Japan ..... 58-50742

[51] Int. Cl.[4] ..... F02M 59/20; F02M 39/00

[52] U.S. Cl. ..... 123/501; 434/3; 434/5

[58] Field of Search ..... 123/501; 434/3, 5

[56] References Cited

U.S. PATENT DOCUMENTS 3,683,879 8/1972 Timms ..... 123/501
4,227,498 10/1980 Eberl ..... 123/501
4,332,227 6/1982 Bauer ..... 123/501
4,354,473 10/1982 Geyer ..... 464/3
4,425,896 1/1984 Murayama ..... 123/501

FOREIGN PATENT DOCUMENTS 54-3617 1/1979 Japan .
1441415 6/1976 United Kingdom ..... 464/5

*Primary Examiner*—Ronald H. Lazarus
*Attorney, Agent, or Firm*—Cushman, Darby & Cushman

[57] ABSTRACT

An injection timing control device of the present invention has a timer cover opened at one end and including at the other an end wall portion. The end wall portion of the timer cover is formed with hole concentric with the axis, and a gear driven by an engine, is provided at the outside surface of the end wall portion. In the time cover is disposed a timer hub concentric to the axis. The timer hub can be inserted into the hole, and has a cam boss connected at one end to the fuel injection pump cam shaft and a flange formed integrally with the other end side of the cam boss.

14 Claims, 9 Drawing Figures

FUEL INJECTION TIMING CONTROL DEVICE

BACKGROUND OF THE INVENTION

The present invention relates to a fuel injection timing control device of a fuel injection pump in response to the rotating speed of an internal combustion engine and, more particularly, to a device adapted for a small universal engine.

A device of this type for controlling the fuel injection timing of a fuel injection pump is termed "an automatic timer". This automatic timer serves to advance or delay the injection time of fuel injected into the cylinders of an engine from a fuel injection pump in response to the rotating speed of the engine, and is used such that the pressure in the cylinders reach the maximum value at an optimum time in response to the movement of the piston reciprocating in the cylinder.

An automatic timer, which was disclosed in Japanese Patent Disclosure No. 3617/1979, is known as an automatic timer of this type. This conventional automatic timer is disposed between an engine and a fuel injection pump. In the automatic timer, a driven gear, provided concentrically with one end side of the timer, is engaged in mesh with a drive gear rotated by an engine, while the automatic timer is connected serially to the fuel injection pump cam shaft.

With this conventional automatic timer, applied to a small general engine, the following observations have been made. Engines can be classified into two types according to the position of the drive gear. One of these engines is adapted for an automatic timer having a driven gear at one end as described above, while the other type is adapted for an automatic timer having a driven gear at the other end. Thus, two types of the automatic timers should be required in view of the position of the driven gear. However, in order to manufacture automatic timers of two types drawbacks, such as increased manufacturing cost, error in assembling the parts and complications in managing the exchange of spare parts for the two types of automatic timers arise.

SUMMARY OF THE INVENTION

The present invention has been made in consideration of this and has for its object to provide a device for controlling the injecting timing of a fuel injection pump used for an internal combustion engine and capable of being applied to two types of engines from the point of view of the drive gear position, decreasing manufacturing cost, and readily managing the exchange of spare parts.

According to the present invention, a fuel injection timing control device comprises a cup shaped cover opened at one end and closed at the other by an end wall portion, this cover having a hole formed concentrically with the axis of the cover in the end wall portion and a driven gear disposed concentrically with the axis on the outside end face of the end wall portion for rotatably driving the cover around the axis in mesh with the drive gear, which is rotated by the engine; a hub disposed concentrically with the axis in the cover and relatively rotatable to the cover, the hub including a boss portion whose outer diameter is not larger than the hole in the end wall portion and the boss portion having at one end a connecting portion for a detachable connection to a cam shaft of a fuel injection pump and a flange integrally formed with the other end side of the boss portion and at one side face slidably contacted with the inner surface of the end wall portion of the cover; and adjusting means contained in the cover and engaged with the end wall portion of the cover for adjusting the phase angle of the rotating hub to the rotation of the cover in response to the operating state of the engine.

According to the present invention, the outer diameter of the hub's boss portion is not larger than the hole of cover's end wall portion. Thus, the boss portion of the hub can be inserted into the hole. In this manner, the hub may be disposed in the cover so that the boss connecting portion is located at the open end side of the cover or the boss connecting portion is located at the hole side of the cover. The device of the present invention can be mounted on the cam shaft such that the opening end of the cover is close to the cam shaft of the fuel injection pump, and contrarily mounted on the cam shaft such that the open end of the cover is remotely isolated from the cam shaft of the fuel injection pump. Accordingly, when the device is used in an inverted manner, the driven gear provided in the cover can be located at either side of the device. In this manner, the device of this invention can be applied to both types of engines in accordance with the position of the drive gear. As a result, it is not necessary to exclusively prepare the device for the two types of engines. Therefore, the manufacturing cost of the device can be significantly reduced, error in assembling the parts can be eliminated at assembly time, and the management of exchanging spare parts can be facilitated.

BRIEF DESCRIPTION OF THE DRAWINGS

Other objects and advantages of the present invention can be readiy clarified from the detailed description of the embodiments when taken in conjunction with the accompanying drawings.

DETAILED DESCRIPTION OF THE PREFERRED EMBODIMENTS

Figure 2:
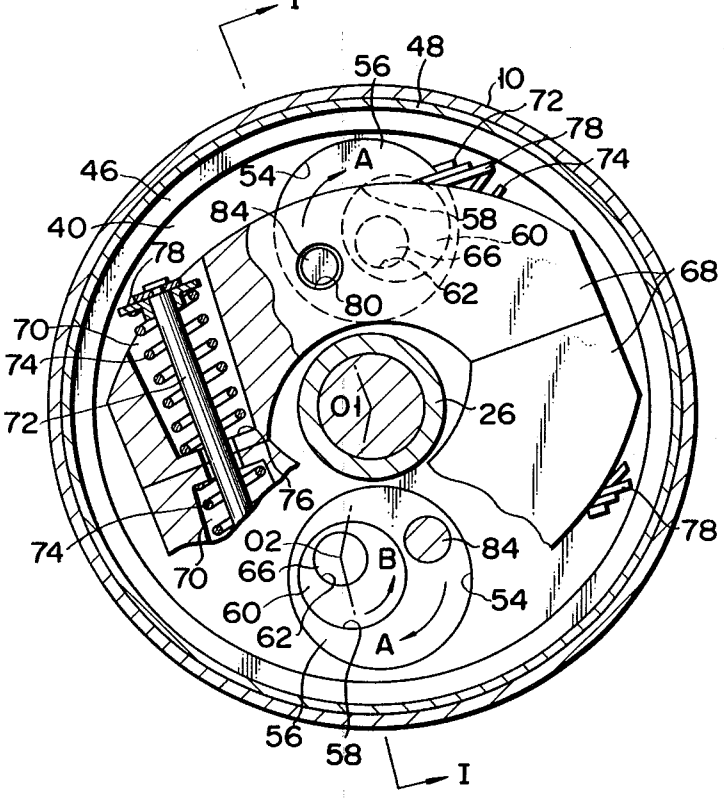
FIG. 2 is a sectional view taken along the line II—II in FIG. 1.
Figure 1:
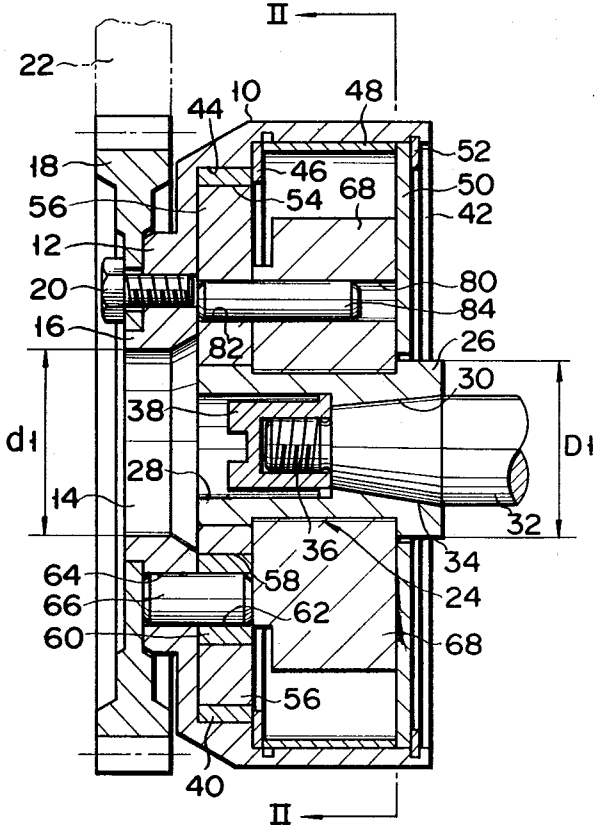
FIG. 1 is a sectional view taken along the line I-O-I in FIG. 2 showing a first embodiment of the present invention.

Referring to FIGS. 1 and 2, an injection timing control device according to a first embodiment of the present invention is shown. This injection timing control device controls the injection timing of a fuel injection pump used for an internal combustion engine (not shown) in response to a operating state of the engine.

The injection timing control device comprises a timer cover 10. This timer cover 10 has a substantially cylindrical shape opened at one end and closed at the other by an end wall portion 12. At the end wall portion 12 of the timer cover 10, a hole 14 is concentrically formed with the axis of the timer cover 10. On the outside surface of the end wall portion 12 is protruded a cover boss portion 16 concentrically with the axis of the timer cover 10 toward the outside.

A driven gear 18 is mounted on the gear boss portion 16 of the timer cover 10. This driven gear 18 is securely fixed to the outside surface of the end wall portion 12 of the timer cover 10 with a plurality of fixing bolts 20. Various types of gears, such as a spur gear or a helical gear, are used for the driven gear 18. The indispensable condition for the driven gear 18 is that both side faces of the driven gear 18 are formed symmetrically with the axis as a center. Thus, the driven gear 18 can be inverted from the state shown in FIG. 1 and mounted on the timer cover 10.

Further, the driven gear 18 is engaged, as shown in FIG. 1, in mesh with an engine drive gear 22. This drive gear 22 is rotatably driven by the engine. Therefore, the engine's rotary drive force is transmitted through the drive gear 22 and the driven gear 18 to the timer cover 10. Thus, the timer cover 10 is synchronicaly rotatable with the engine around its axis.

It is noted that the engine is constructed of the type where the engine drive gear 22 is engaged in mesh with the driven gear 18 so that the timer cover 10 is mounted, as shown in FIG. 1, at the opening end at the right side.

A timer hub 24 is concentrically disposed in the timer cover 10. This timer hub 24 has a cam boss 26. A central hole 28 is formed along the axis at the cam boss 26, and has at one end a tapered hole portion 30 converging toward the interior. A tapered portion 34 of a fuel injection pump cam shaft 32 is engaged with the hole portion 30 of the cam boss 26, and a round nut 38 is screwed to the threaded portion 36 formed on the end of the tapered portion 34, and this cam shaft 32 is connected to the cam boss 26 and hence the timer hub 24. In this manner, the timer hub 24 is integrally rotatable with the fuel injection pump cam shaft 32.

It is noted, as shown in FIG. 1, that the relationship between $D_1$ and $d_1$ is set at $d_1 > D_1$, where $D_1$ is the maximum outer diameter of the cam boss 26 of the timer hub 24, and $d_1$ is the bore of the hole 14 in the timer cover 10.

A flange 40 is formed integrally with the other end of the cam boss 26. The flange 40 is engaged with a step 44 having a bore smaller than that of the open end 42 of the timer cover 10. Thus, the flange 40 is constructed such that the outer peripheral surface and one side face opposite the inner surface of the timer cover's end wall portion 12 are slidably contacted with the inner surface of the timer cover 10 so as to be rotatable in the step 44.

As the other side face of the flange 40 of the timer hub 24 is contacted a ring-shaped first thrust plate 46. The first thrust plate 46 is held by a thrust collar 48 engaged within the timer cover 10 and a circular clip 52 mounted on the open end 42 of the timer cover 10 together with a second thrust plate 50 to be described later.

As apparent from FIG. 2, a pair of large-diameter holes 54 are formed at positions symmetrical to the axis as a center on the flange 40 of the timer hub 24, and large-diameter disc cams 56 are rotatably engaged with the holes 54. Further, small-diameter holes 58 are formed at positions eccentric to the rotating centers of the cams 56 at the cams 56, and small-diameter disc cams 60 are rotatably engaged with the holes 58. Pin holes 62 are formed at positions eccentric to the rotating center of the cams 60 at the cams 60, and the pin holes 64 are formed at positions center to the holes 62 at the end wall portion 12 of the timer cover 10. First pins 66 are inserted into sets of pin holes 62 and 64. Thus, the end wall portion 12 of the timer cover 10 is engaged through the first pins 66 to the cams 60.

In the timer cover 10 are disposed a pair of half-ring shaped flyweights 68, interposed between the flange 40 of the timer hub 24 and the second thrust plate 50, functioning as a cover plate for blocking the open end 42 of the timer cover 10 at both sides of the cam boss 26 of the timer hub 25. As evident from FIG. 2, a pair of stepped spring containing holes 70 are formed at both sides the flyweights 68. Guide rods 72 are inserted into the spring containing holes 70 of the set of flyweights 68, and coil springs 74, which surround the guide rods 72, are contained in the spring containing holes 70. Each coil spring 74 is supported at one end by the step 76 of the spring containing hole 70, and at the other end by a spring seat 78 mounted on the guide rod 72. Thus, the pair of flyweights 68 are urged by the urging force of the coil springs 74 toward the direction for radially attraction as shown in FIG. 2. Further, pin holes 80 which extend along the axis of the timer hub 24 are formed at the center portion of the flyweights 68, and the pin holes 82 are formed at positions center to the pin holes 80 at the cams 56. A second pins 84 are inserted into the pin holes 80 and 82 of the sets of flyweights 68 and the cams 56. Thus, the sets of flyweights 68 and the cams 56 are connected through the second pins 84.

The operation of the aforementioned injection timing control device will be described in detail. When the timer cover 10 is synchronically rotated with the engine, the small-diameter disc cams 60 tend to rotate around the axis of the timer cover 10 through the first pins 66. Then, the cams 56 and hence the timer hub 24 are rotated around the axis. Accordingly, when the timer cover 10 is rotated, the cam shaft 32 of the fuel injection pump is rotated through the first pins 66, small and large diameter disc cams 60 and 56 and the timer hub 24, thereby operating the fuel injection pump. At this time, since the flange 40 of the timer hub 24 is connected to each other through the pins 84 and the large-diameter cam 56 to the flyweights 68, the flyweights 68 also rotate with the timer hub 24.

When the rotating speed of the engine is accelerated so that a centrifugal force acting on the flyweights 68 increases, the flyweights 68 are guided radially outward by the guide rods 72 and moved against the urging force of the coil springs 74 in a direction isolating them from each other. Therefore, the cams 56 are rotated around their own axes in the holes 54 through the second pins 84 as shown by an arrow A in FIG. 2, in response to the displacement of the flyweights 68. Simultaneously, upon rotation of the cams 56 around their own axes, the cams 60 engaged eccentrically with the cams 56 should be rotated around their own axes in the holes 58 toward the direction shown by an arrow B in FIG. 2. In other words, the cams 60 rotate around their own axes in the holes 58 at a rotary angle corresponding to the moved displacement of the flyweights 68. Thus, when the cams 60 rotate around their own axes, the flange 40 of the timer hub 24 rotates relative to the timer cover 10 in the step 44, because the cams 60 and the end wall portion 12 of the timer cover 10 are connected through the first pins 66. In other words, the phase angle of the timer hub's 24 rotation to the rotation of the timer cover 10 is altered. Thus, in case, the cam shaft 32 of the fuel injection pump rotates at advance angle to the rotation of the timer cover 10. As a result, the injection timing of the fuel injection pump is advanced in response to the rotating speed of the engine.

On the other hand, when the rotation of the engine is decelerated from the high speed range, the flyweights 68 move to radially approach each other by the recoiling strength of the coil springs 74. Thus, the advance angle of the timer hub 24 to the rotation of the timer cover 10 is diminished by the aforementioned operation.

In the above description, the first embodiment of the injection timing control device as applied to one type of engine has been described. What will now be described with reference to FIGS. 3 to 5 is another example of the injection timing control device of the first embodiment as applied to another types of engine.

Figure 3:
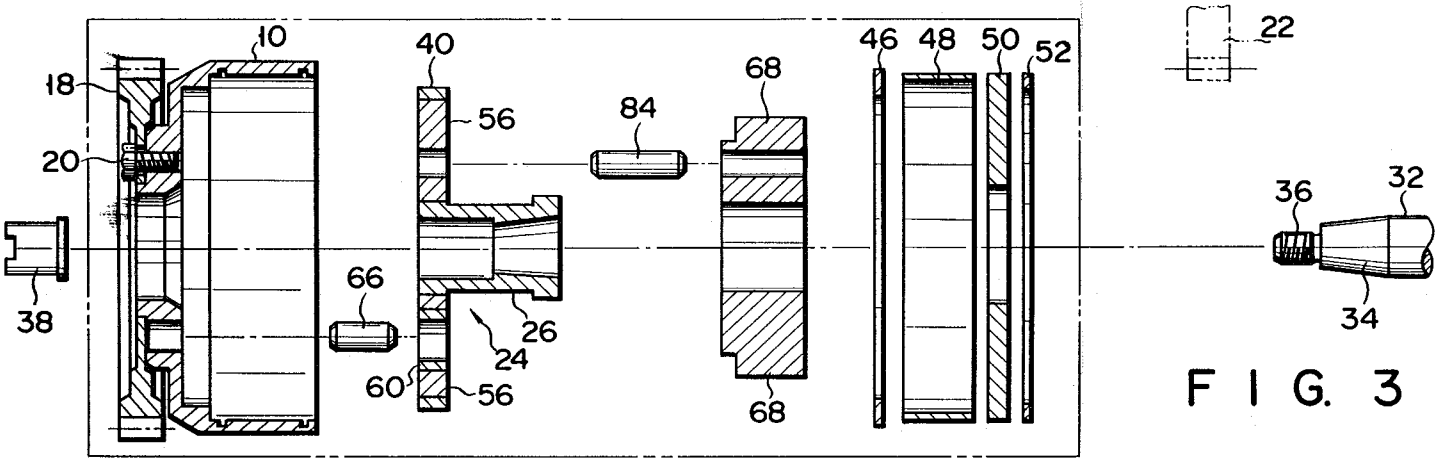
FIG. 3 is a view showing the device of FIG. 1 applied to one type of engine removed from a cam shaft of a fuel injection pump and disassembled.
Figure 4:
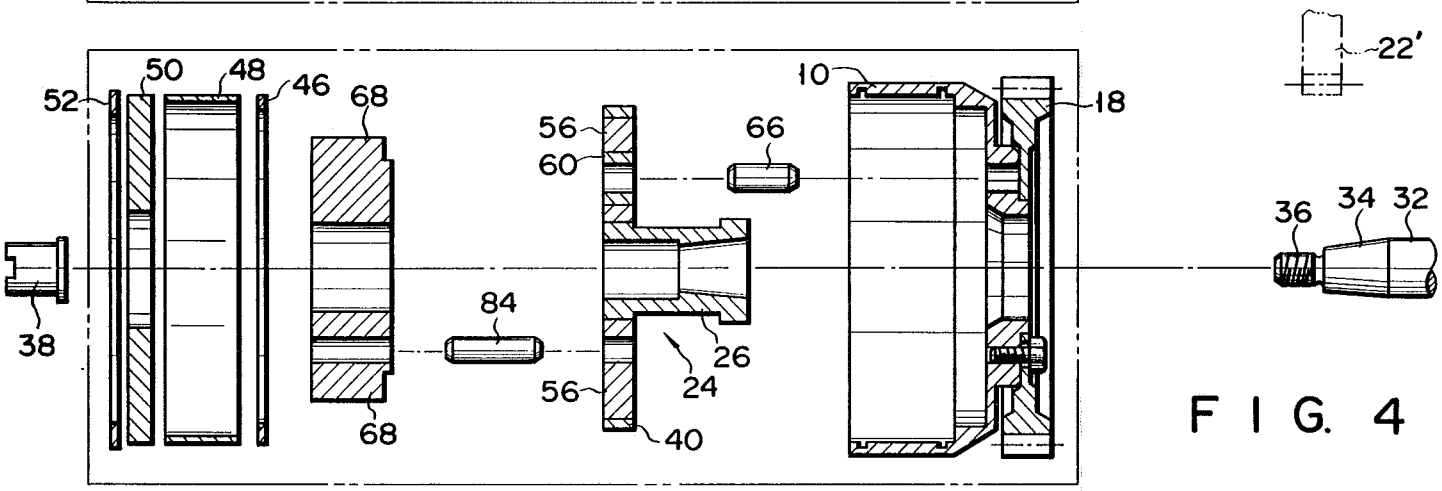
FIG. 4 is a view showing the assembling procedure of the device of FIG. 1 when applied to the engine of the other type.

Referring to FIG. 3, a procedure for removing disassembling, and reassembling the injection timing control device from the engine and the cam shaft of the fuel injection pump is shown. The round nut 38 is first removed from the fuel injection pump cam shaft 32. Thus, the entire injection timing control device is removed from the engine drive gear 22 and the fuel injection pump cam shaft 32. As shown in a broken line block in FIG. 3, the circular clip 52 is removed from the timer cover 10, and the second thrust plate 50, the thrust collr 48, the first thrust collar 46, the flyweights 68 and the timer hub 24 are sequentially removed. Then, as shown in a broken line block in FIG. 4, the timer cover 10 is inverted from the state shown in FIG. 3, and the timer hub 24 is associated with the timer cover 10 such that the cam boss 26 is inserted into the opening hole 14 of the end wall portion 12 of the timer cover 10. Thereafter, the flyweights 68, the first thrust plate 46, the thrust collar 48, the second thrust plate 50, and the circular clip 52 are sequentially associated with the timer cover 10 to complete the reassembly of the injection timing control device.

Figure 5:
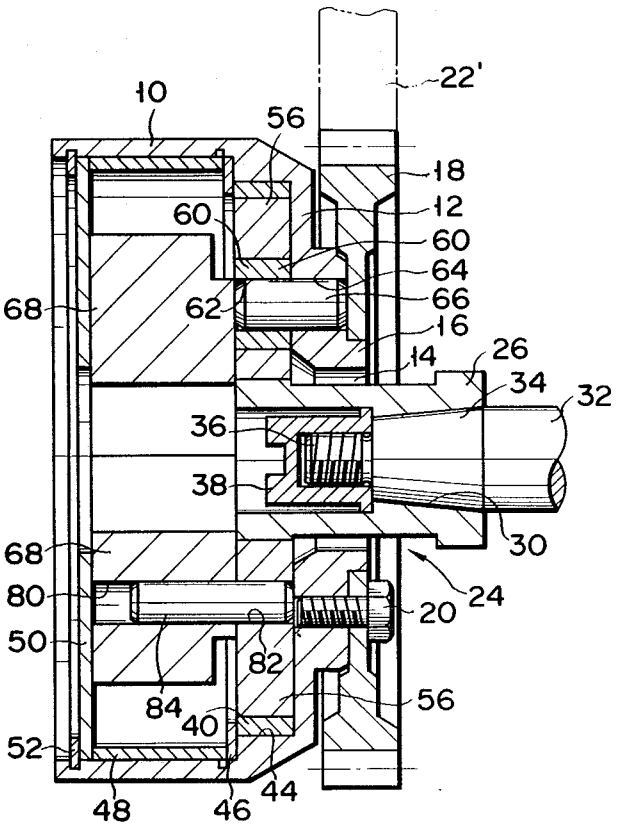
FIG. 5 is a view showing the device assembled by the assembling sequence illustrate in FIG. 4 in the state mounted on the cam shaft of a fuel injection pump.

The timer hub 24 of the injection timing control device associated in this manner is now connected to the cam shaft 32 of the fuel injection pump through the round nut 38 to connect the injection timing control device to the fuel injection pump, as shown in FIG. 5. In this case, as apparent from FIG. 5, the driven gear 18 of the timer cover 10 is positioned at the right side of the timer cover 10, opposite to its position in FIG. 1, and engaged in mesh with the engine drive gear 22'. Accordingly, one type of injection timing control device can be applied to both types of engines, as seen from the position of the drive gear, merely by altering the assembling procedure of the injection timing control device in response to the positions of the engine drive gears 22 (or 22').

In the case of the injection timing control device of the above first embodiment, the driven gear 18 is detachable from the timer cover 10. Accordingly, the small diameter gear, smaller than the outer diameter of the timer cover 10, may be employed for the drive gear 18. This means that, when the injection timing control device is applied to the small general engine, the mounting space of the device may advantageously be small enough if the diameter of the driven gear 18 is small. Further, when the diameter of the driven gear 18 is small, the eccentricity of the driven gear 18 to the cam shaft 32 can be suppressed to a small value. Thus, the engagement of the drive gear 22 (or 22') with the driven gear 18 may be improved, noise caused by this engagement can be reduced, and the irregular wear of the teeth surfaces of the driven gear 18 can be reduced. Consequently, the lifetime of the driven gear 18 can be increased.

Moreover, when the driven gear 18 is helical, both side surfaces of the helical gear 18 are symmetrically formed with the axis as a center. Accordingly, the helical gear 18 is inverted and mounted on the timer cover 10, thereby engaging the helical gear 18 with the engine drive gear 22 (or 22').

The present invention is not particularly limited to the first embodiments of the injection timing control device. Other embodiments of the invention will be described with reference to FIGS. 6 to 8. To described the other embodiments, the members of the same functions as those in the first embodiment are designated by the similar reference numerals and will be omitted in description.

Figure 6:
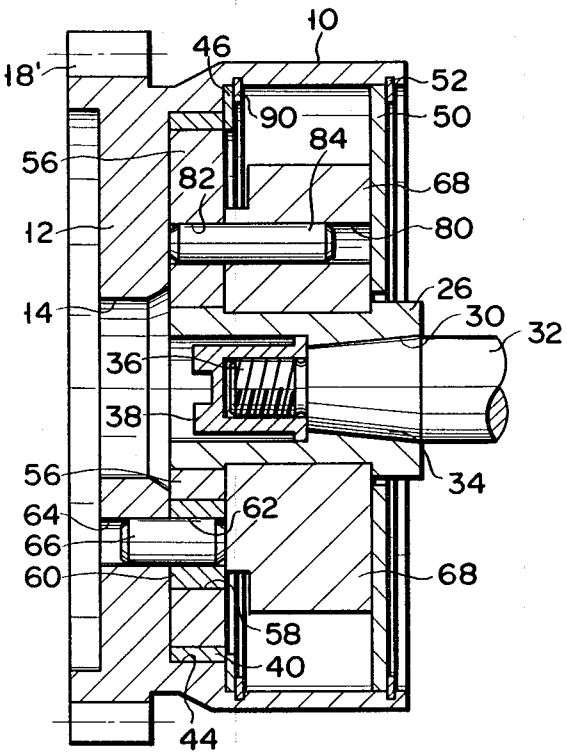
FIG. 6 is a sectional view of the device showing a second embodiment of the present invention.

Referring to FIG. 6, a fuel injection timing control device of a second embodiment of the present invention is shown. The injection timing control device of this second embodiment has two different points from that of the first embodiment. The first point is that the driven gear 18' is formed integrally with the timer cover 10, and the second point is that the first thrust plate 46 is clamped by another circular clip 90 and the thrust collar 48 is omitted.

Figure 8:
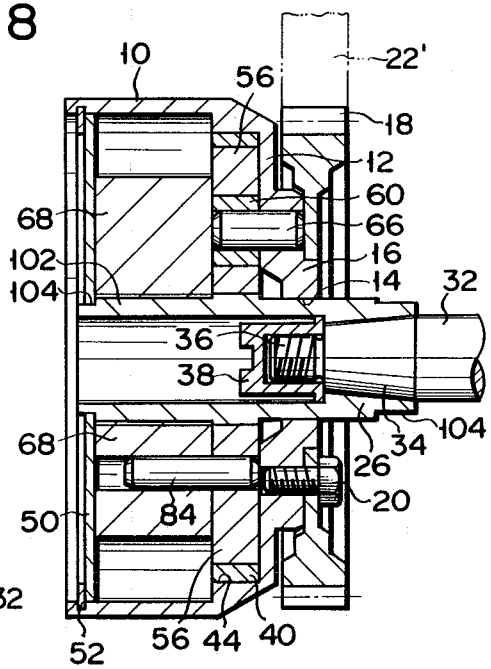
FIG. 8 is a view showing the state of an alternative mounting of the device of FIG. 7.
Figure 7:
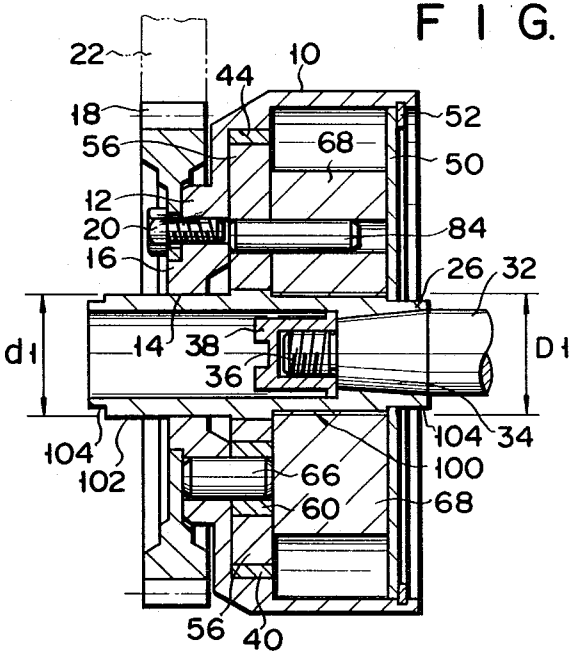
FIG. 7 is a sectional view of the device showing a third another embodiment of the present invention.

Referring to FIGS. 7 and 8, an injection timing control device of a third embodiment of the present invention is shown. There are three different points of the third embodiment from the first embodiment of the injection timing control device. The first point is that the timer hub 100 of the injection timing control device of the third embodiment is formed with a flange 40 integrally at the center portion of the cam boss 26. Accordingly, as shown in FIG. 7, the boss portion 102 of the left side of the cam boss 26, protruding to the left side of the flange 40, passes through the hole 14 of the end wall portion 12 of the timer cover 10, and is extended toward the outside. The left side boss portion 102 is rotatably slidable in the hole 14. Thus, the maximum outer diameter $D_1$ of the cam boss 26 is substantially equal in size to the inner diameter $d_1$ of the opening hole 14 of the end wall portion 12. Further, steps 104 for supporting the second thrust plate 50 are formed at both ends of the cam boss 26. The second point is that, in the case of the third embodiment, the first thrust plate 46 is omitted and only the second thrust plate 50 is used. The third point is that, in the case of the third embodiment, the outer diameter of the driven gear 18 is smaller than that of the timer cover 10.

As shown in FIGS. 7 and 8, the driven gear 18 can be altered to the left or right side even in the injection timing control device of the third embodiment.

Figure 9:
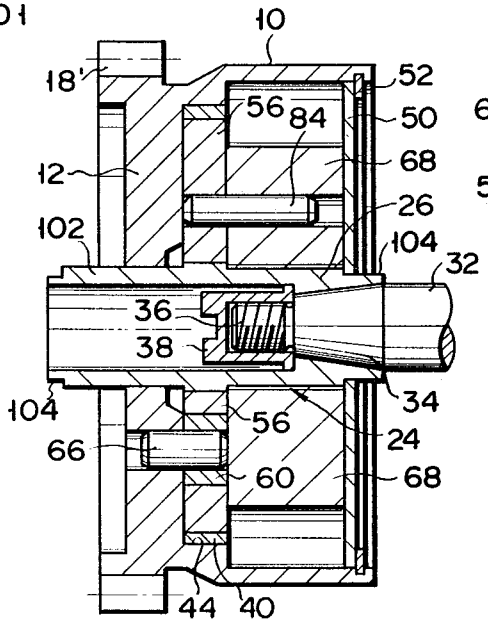
FIG. 9 is a sectional view of the device showing a fourth embodiment of the invention.

Referring to FIG. 9, an injection timing control device of a fourth embodiment of the present invention is shown. The different point of the fourth embodiment from the third embodiment of the injection timing control device is that the driven gear 18' is formed integrally with the timer cover 10.

What is claimed is:

1. A device attachable to the cam shaft of a fuel injection pump for an internal combustion engine for controlling injection timing of the pump, comprising:

a cup-shaped cover open at one end and closed at the other by an end wall portion, said cover having a hole formed concentrically with the axis of said cover in said end wall portion and a driven gear disposed concentrically with said axis on the outside end face of said end wall portion for rotatably driving said cover around said axis when in mesh with a drive gear rotated by the engine;

a hub disposed concentrically with said axis and rotatable relative to said cover, said hub including a pipe-shaped boss portion whose outer diameter is not larger than said hole, said boss portion having at one open end a connecting portion for detachable connection to the cam shaft and a flange integrally formed on the outer periphery of said boss portion, said flange being axially spaced from said boss portion open by a predetermined distance and having a side face slidably contacting the inner surface of said end wall portion of said cover;

means for adjusting the phase angle of said hub to the rotation of said cover in response to an operating state of the engine, said adjusting means including phase angle adjusting members rotatably disposed in said flange, and a pair of flyweight plates received in said cover and displaceable radially outwardly by contrifugal force, each of said flyweight plates having one side face slidably contacting the other side face of said flange; and a thrust plate disposed in said cover in the vicinity of said cover open end and being in contact with the other side face of said flyweight plates such that said thrust plate bears the thrust load of said plates.

2. A device according to claim 1, wherein the thrust plate blocks the open end of the cover.

3. A device according to claim 1, further comprising an another thrust plate mounted in the cover in contact with the other side surface of the flange for bearing the thrust load of said flange.

4. A device according to claim 3, wherein the boss portion of the hub integrally comprises a cylindrical portion concentrically protruded from the flange with the cylindrical portion having the same outer diameter as the outer diameter of said boss portion.

5. A device according to claim 4, wherein the cylindrical portion of the hub is engaged by the hole and supported by the end wall portion of the cover.

6. A device according to claim 1, wherein said cover is formed as a separate member from the driven gear.

7. A device according to claim 6, wherein the driven gear is detachably mounted in engagement with a gear boss protruded from the outside surface of the end wall portion of the cover.

8. A device according to claim 1, wherein the cover and the driven gear are formed of an integral member.

9. A device according to claim 6, wherein the shapes of both end sides of the driven gear are symmetrical with the axis thereof as a center.

10. A device according to claim 1, wherein the outer diameter of the driven gear is smaller than that of the cover.

11. A device according to claim 1, wherein said phase angle adjusting members comprise: a pair of large-diameter disc-shaped cams rotatably fitted in a pair of large-diameter holes formed symmetrically to the axis at the flange, said cams being connected to their respective flyweight plates through first pins which are eccentric to said cams; and a pair of small-diameter disc-shaped cams rotatably fitted in a pair of small-diameter holes formed eccentrically to said large-diameter disc-shaped cams, said small-diameter disc-shaped cams being connected to their respective flyweight plates through second pins which are eccentric to said small-diameter disc-shaped cams.

12. A device according to claim 1, further comprising a holding member disposed at the open end of said cover for holding the thrust plate.

13. A device according to claim 12, wherein the holding member is a circular clip fitted into an annular groove formed in the inner periphery of the open end of said cover.

14. A device according to claim 13, further comprising a thrust collar disposed between the end wall portion and the thrust plate in the inner periphery of said cover for supporting said thrust plate.

* * * * *